US005797507A

United States Patent [19]

Kramer

[11] Patent Number: 5,797,507

[45] Date of Patent: Aug. 25, 1998

[54] NESTABLE HOLIDAY CONTAINER

[76] Inventor: Stanley Kramer, 404 Fireside La., Cherry Hill, N.J. 08003

[21] Appl. No.: 716,118

[22] Filed: Sep. 19, 1996

[51] Int. Cl.[6] ..... B65D 8/18

[52] U.S. Cl. ..... 220/4.23; 220/4.21; 220/771; 220/339; 220/264; 206/457; 206/518

[58] Field of Search ..... 220/771, 4.23, 220/4.22, 4.21, 4.24, 264, 337, 339; 206/457, 459.1, 515, 518

[56] References Cited

U.S. PATENT DOCUMENTS

| | | | |
|---|---|---|---|
| D. 320,298 | 9/1991 | Apps et al. . | |
| 2,798,784 | 7/1957 | Marshall | 220/4.22 |
| 3,871,519 | 3/1975 | Groomes | 220/4.22 |
| 3,887,073 | 6/1975 | Wilson . | |
| 4,185,767 | 1/1980 | Sykora . | |
| 4,523,692 | 6/1985 | Lemkin . | |
| 5,156,291 | 10/1992 | Mielke | 220/264 |
| 5,195,638 | 3/1993 | Zinbarg | 206/457 |
| 5,197,603 | 3/1993 | Lundberg . | |
| 5,294,764 | 3/1994 | Mass . | |
| 5,379,911 | 1/1995 | Goto et al. | 220/339 |
| 5,473,142 | 12/1995 | Mass . | |
| 5,515,993 | 5/1996 | McManus | 220/4.23 |

OTHER PUBLICATIONS

Kaleidoscope Catalogue, Author and Title Unknown, date 1978, p. 8.

*Primary Examiner*—Stephen J. Castellano

*Attorney, Agent, or Firm*—Caesar, Rivise, Bernstein, Cohen & Pokotilow, Ltd.

[57] ABSTRACT

A nestable holiday container having two members that are pivotally connected so that the container can store an item, such as a dinner meal, whereby the two members are then closed around the item to contain the item inside. The container can be later opened up, the item removed, and the container reclosed. A perforation is provided so that an opening in the container is created while the container remains closed and other items, such as candy or toys, can be inserted through the opening. Stickers are also provided to be applied to the container for decoration and may also be light-reflective if the container is to be used at night along a roadway, such as for trick-or-treating on Halloween. When the container is in an open condition, the two members can be nested within other nestable holiday containers for storage and shipping.

9 Claims, 3 Drawing Sheets

NESTABLE HOLIDAY CONTAINER

SPECIFICATION

FIELD OF THE INVENTION

This invention relates generally to the field of containers, more particularly, to reusable nestable containers.

BACKGROUND OF THE INVENTION

The following United States Patents describe various types of storage containers: U.S. Pat. Nos. 5,473,142 (Mass); 5,294,764 (Mass); 5,197,603 (Lundberg); 5,195,638 (Zinbarg); 4,523,692 (Lemkin); 4,185,767 (Sykora et al.); 3,887,073 (Wilson) and Des. 320,298 (Apps et al.).

The apparatus disclosed by U.S. Pat. Nos. 5,473,142 (Mass) and 5,294,764 (Mass) is a reusable microwave popcorn container that resembles a playball or other novelty item.

The apparatus disclosed by Lundberg is a storage unit having a decorative component which is placed into a basket or similar receptacle on top of a stored package so that the stored package is readily available without being obtrusive.

The apparatus disclosed by Zinbarg are decorative structures that comprise a combination of a flexible sheet member and a decorative bag member for creating a well-known theme.

The apparatus disclosed by Lemkin is a nestable tote box that utilizes a reversible security cover.

The apparatus disclosed by Sykora et al. is an ornamental package structure including top flaps that include ornamentation tabs so that when the package structure is assembled the ornamentation tabs cooperate to form an ornamentation on top of the package.

The apparatus disclosed by Wilson is a nestable receptacle formed of wire for supporting merchandise for transportation or display.

Apps et al. discloses a design for a stackable and nestable box.

However, it is believed that a need exists for a reusable container incorporating a holiday theme therein that can be nested within other such reusable containers when the containers are in an open condition for storage or shipping.

OBJECTS OF THE INVENTION

Accordingly, it is the general object of this invention to provide an apparatus which addresses the aforementioned needs.

It is a further object of this invention to provide a holiday container that is reusable.

It is yet another object of this invention to provide a holiday container that is nestable in an open condition.

It is still yet a further object of this invention to provide a holiday container that permits an opening to be formed when the container is in a closed condition.

It is still yet even a further object of this invention to provide a holiday container that can be decorated with stickers.

It is yet even another object of this invention to provide a holiday container that can be decorated with light-reflective stickers.

SUMMARY OF THE INVENTION

These and other objects of the instant invention are achieved by providing a nestable container for holding a plurality of items wherein the nestable container comprises a first member having a holiday ornamentation (e.g., jack-o-lantern, Santa Claus, Easter bunny, etc.) incorporated therein and having a first periphery surface and a second member pivotally coupled to the first member and having a second periphery surface. The first periphery surface and the second periphery surface have mating surfaces which form a friction fit for locking the first member and the second member in a closed condition to form a container.

DESCRIPTION OF THE DRAWINGS

Other objects and many of the attendant advantages of this invention will be readily appreciated as the same becomes better understood by reference to the following detailed description when considered in connection with the accompanying drawings wherein.

DESCRIPTION OF THE PREFERRED EMBODIMENT OF THE INVENTION

Figure 1:
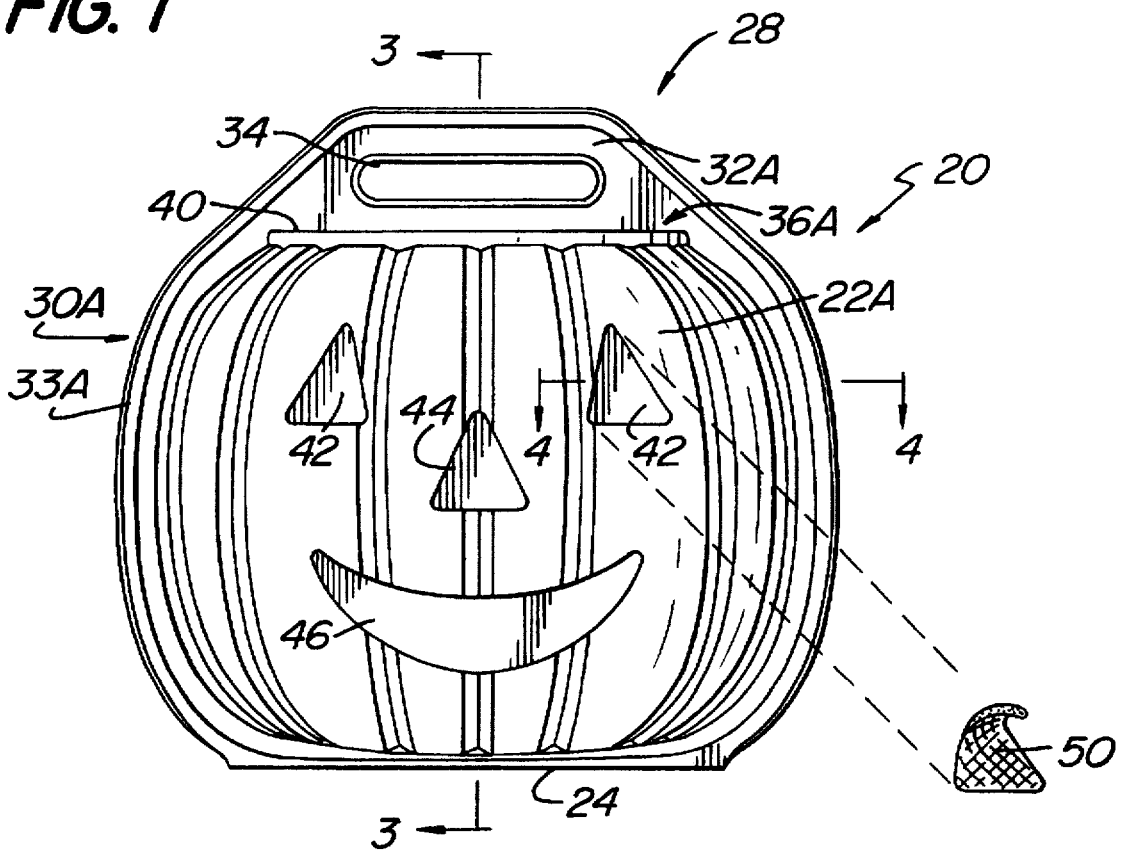
FIG. 1 is a front view of the nestable holiday container.
Figure 2:
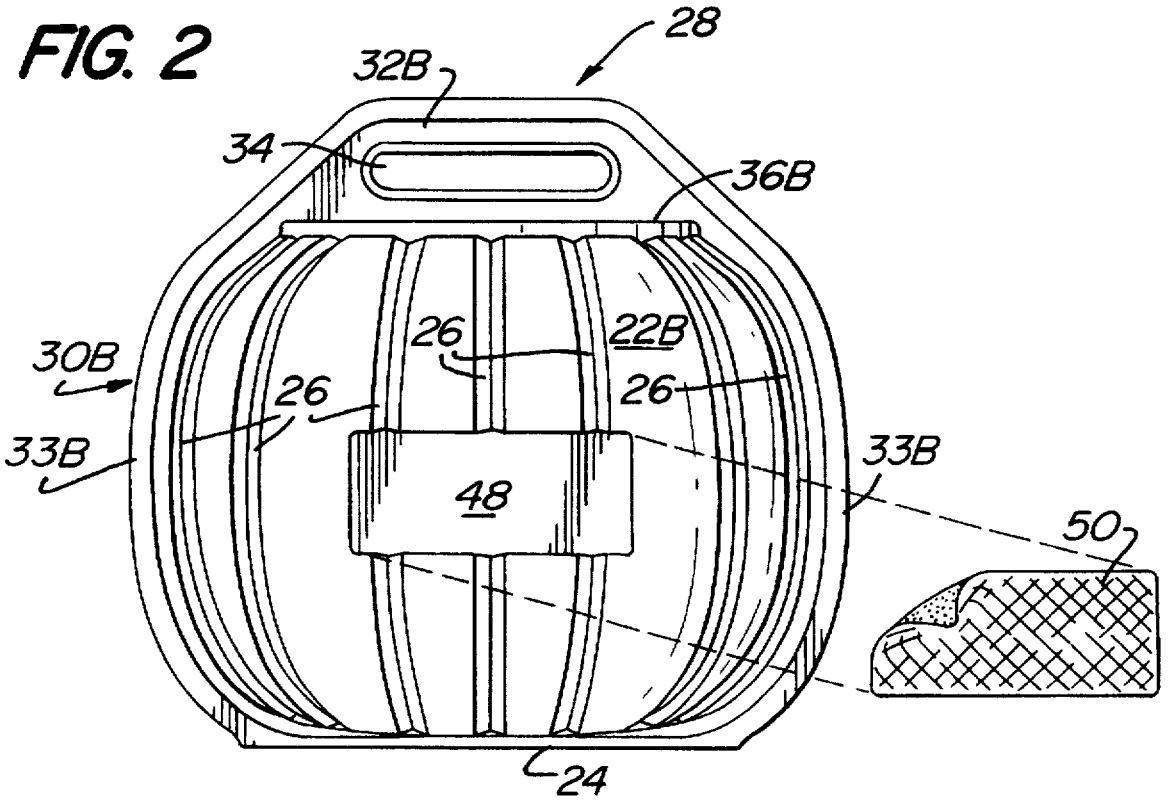
FIG. 2 is a rear view of the nestable holiday container.

Referring now in greater detail to the various figures of the drawing wherein like reference characters refer to like parts, a nestable holiday container (hereinafter NHC) constructed in accordance with the present invention is shown generally at 20 in FIG. 1.

It should be noted at this juncture that the theme of the NHC 20 can be a jack-o-lantern (for Halloween), a Santa Claus, an Easter bunny, etc. In the present application, a jack-o-lantern has been selected as an exemplary NHC 20 but the NHC 20 is not limited to the jack-o-lantern theme.

Figure 3:
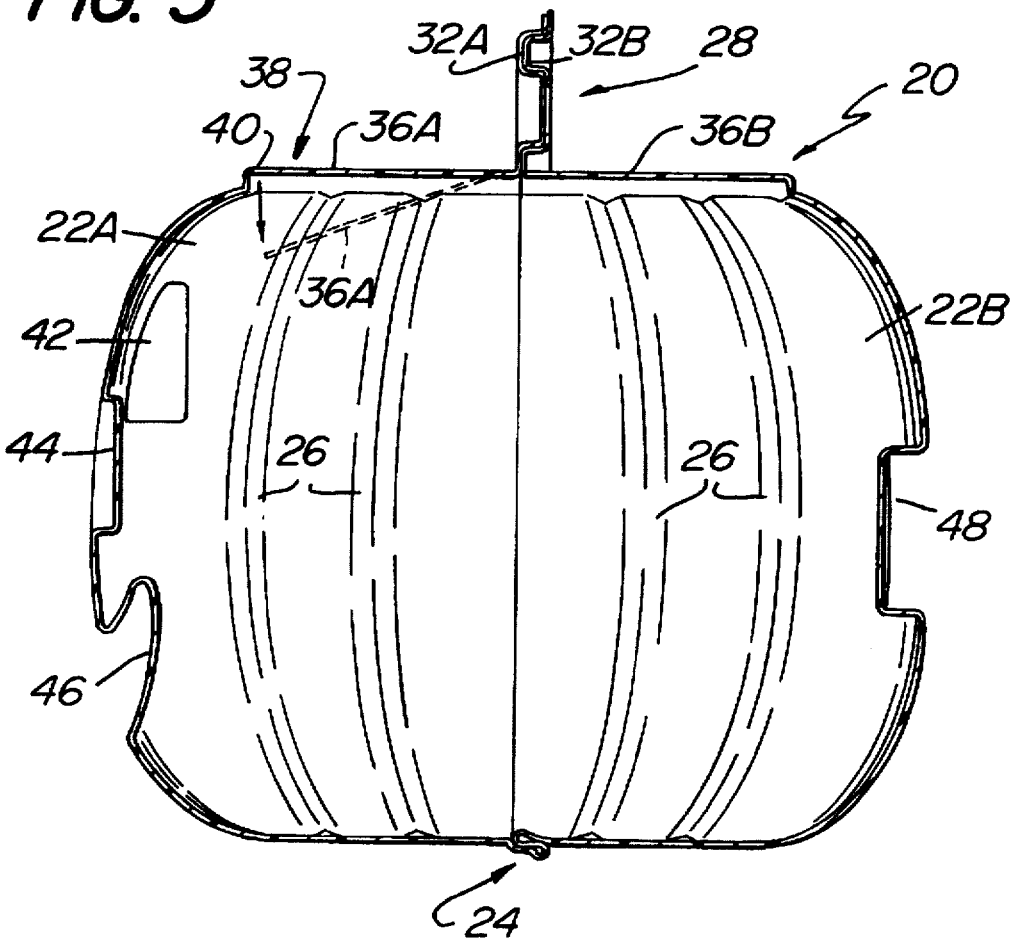
FIG. 3 is a cross-sectional view of the nestable holiday container taken along lines 3—3 of FIG. 1.

In particular, the NHC 20 comprises a front member 22A and a back member 22B (FIG. 3) that are pivotally connected at a hinge 24 to form a container for storing material (e.g., meals, candies, toys, etc., not shown) inside. Hence, the NHC 20 can be in an closed condition (FIGS. 1–4) or in an open condition (FIG. 5). The members 22A and 22B are ribbed and comprise a durable plastic material, e.g., PVC (polyvinyl chloride). The ribs 26 add strength to the NHC 20 by distributing the weight of the internal items (not shown) around the outside of the NHC 20 up to a handle portion 28.

Each member 22A and 22B has a respective periphery surface 30A and 30B that projects outward from the members along the sides and top. These periphery surfaces 30A and 30B are in contact with each other when the NHC 20 is closed and provide the locking mechanism to hold the members 22A and 22B in the closed condition. The top portion of the periphery surfaces 30A and 30B form the handle portion 28.

As is most apparent from FIG. 7, the handle portion 28 comprises a portion of the periphery surfaces 30A and 30B having mating "squared-S" shaped surfaces 32A and 32B. When the user wishes to close the NHC 20, the user brings the members 22A and 22B together and presses these "squared-S" shaped surfaces 32A and 32B together forming a friction fit that locks the front member 22A and back member 22B together at the handle portion 28. Conversely, to open the NHC 20, the user simply pulls the "squared-S" shaped surfaces 32A and 32B apart out of the friction fit. In addition, the lower portions of the "squared-S" shaped surfaces have oval-shaped cut-outs that form an aperture 34 when the "squared-S" shaped surfaces 32A and 32B are pushed together. The aperture 34 permits the user to stick his/her through in order to grasp the handle portion 28.

Figure 4:
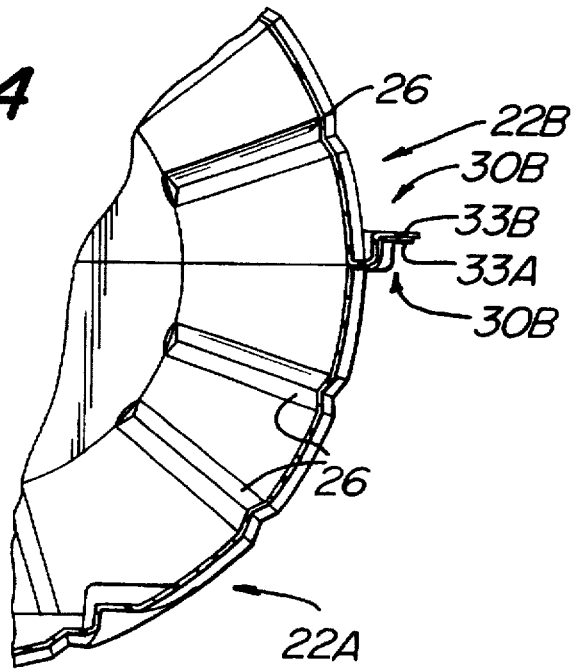
FIG. 4 is a sectional view of the nestable holiday container taken along line 4—4 of FIG. 1.
Figure 5:
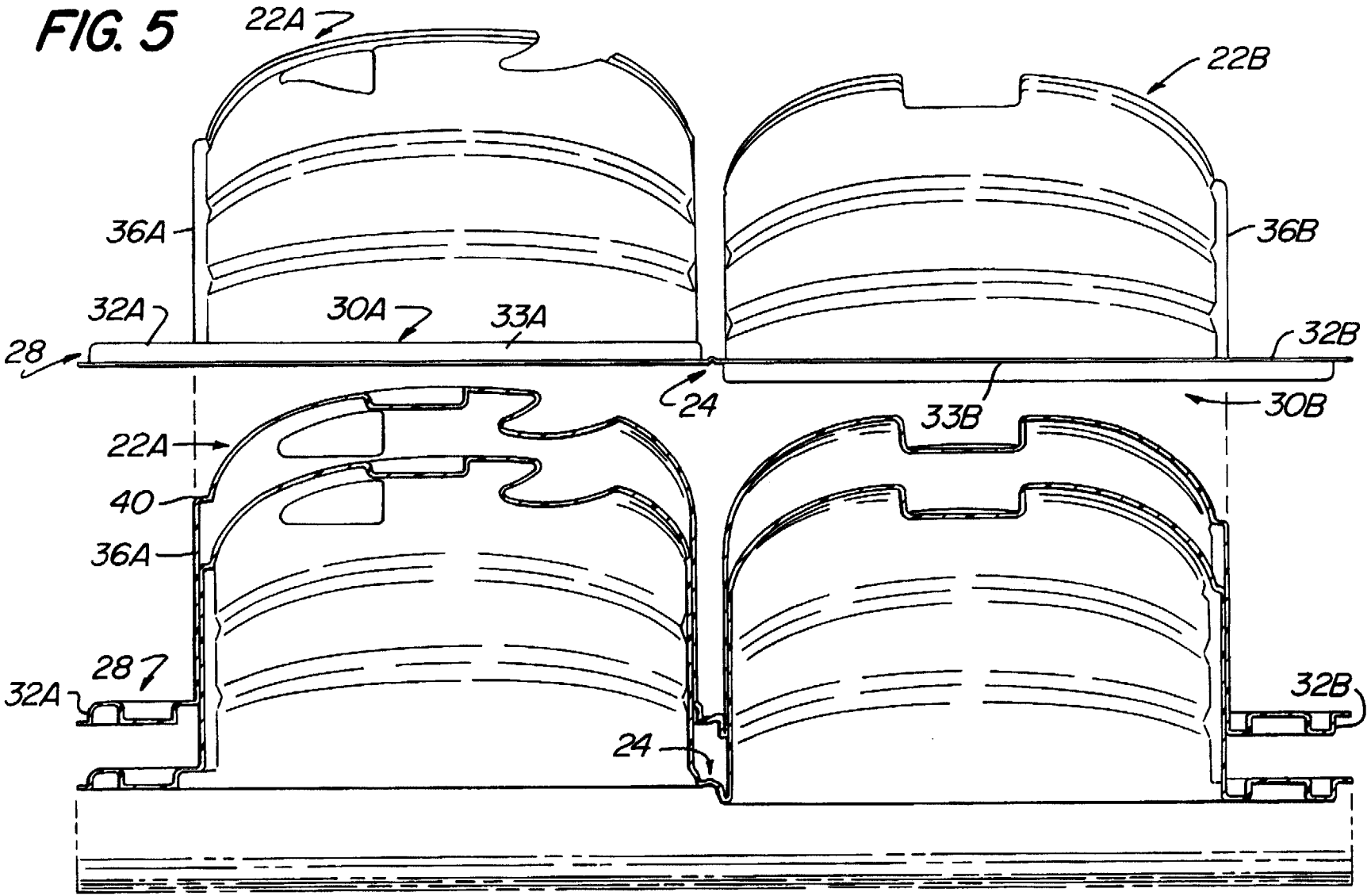
FIG. 5. depicts a stack of a plurality of nestable holiday containers.

As shown most clearly in FIG. 4, the side portions of the periphery surfaces 30A and 30B comprise mating surfaces 33A and 33B that also form a friction fit when these surfaces 33A and 33B are pressed together. When these mating surfaces 33A and 33B are squeezed together by the user, along with the "squared-S" shaped surfaces 32A and 32B in the handle 28, the NHC 20 is securely closed. Conversely, to open the NHC 20, the user simply pulls these mating surfaces 33A and 33B apart out of the friction fit.

Each "squared-S" shaped surface 32A and 32B in the handle 28 is contiguous with the front member 22A and back member 22B, respectively, via respective flat surfaces 36A and 36B, respectively. When the NHC 20 is closed, these flat surfaces 36A and 36B form a flat crown 38. The flat surface 36A forms a perforated edge 40 with the rounded portion of the front member 22A. The perforated edge 40 allows the surface 36A to initially remain relatively perpendicular with respect to the "squared-S" shaped surface 32A when the original contents (e.g., a dinner meal) are closed inside the NHC 20. Later, when the original contents are removed and the interior of the NHC 20 cleaned out, the NHC 20 can be reclosed and the surface 36A can be pushed downward (FIG. 3) by severing the perforated edge 40. Thus, an opening is created at the crown 38 while the NHC 20 is a closed condition. The NHC 20 can now be reused as a container for collecting goods, e.g. Halloween candy, toys, or other holiday gifts, whereby the user can insert the goods through the opening in the crown 38.

As discussed earlier, the front member 22A and back member 22B may contain different types of ornamentation. In the present invention, the ornamentation depicted is that of a jack-o-lantern. In particular, the front member 22A comprises recesses that form the eyes 42, the nose 44, and mouth 46 of the jack-o-lantern. The back member 22B comprises a recess 48 that can be used for a number of purposes, e.g., manufacturer or retailer advertisement, or a decorative sticker 50 can be applied within the recess. The decorative sticker 50 can also be light-reflective, thereby providing a safety feature to the NHC 20 such as when a child carries the NHC 20 along a roadway at night while trick-or-treating during Halloween. Similarly, as shown in FIG. 1, decorative stickers 50 (which can also be light-reflective) can be applied to the eyes 42, nose 44 and mouth 46 of the jack-o-lantern for the same reasons. In addition, by supplying the NHC 20 with a sheet of stickers 50, the child can enjoy decorating the NHC 20 himself/herself.

As shown in FIG. 5, with the NHC 20 in an open condition a plurality of NHCs 20 can be efficiently nested within each other for stacking. Note that the hinge 24 has a lot of play to allow for movement of the two members 22A and 22B during manufacturing and shipping without tearing the hinge 24.

It should be noted that the perforation in the first member 22A could be disposed elsewhere in the first 22A or second member 22B, but not necessarily in a flat crown 38 portion of the NHC 20. For example, the perforation could be in the face of the members 22A or 22B themselves.

In addition, the decorative stickers 50 could be applied to the first 22A and second 22B members independent of any recesses in the members.

Without further elaboration, the foregoing will so fully illustrate my invention that others may, by applying current or future knowledge, readily adopt the same for use under various conditions of service.

I claim:

1. A nestable container for holding a plurality of items, said nestable container comprising:

a first member having a holiday ornamentation incorporated therein and having a first periphery surface;

a second member pivotally coupled to said first member and having a second periphery surface;

said first periphery surface and said second periphery surface having mating surfaces to form a friction fit for locking said first member and said second member in a closed condition to form a container;

said ornamentation comprising recesses in said first member; and wherein said container further comprises decorative stickers to be applied within said recesses.

2. The nestable container of claim 1 wherein said decorative stickers are light-reflective.

3. A nestable container for holding a plurality of items, said nestable container comprising:

a first member having a holiday ornamentation incorporated therein and having a first periphery surface;

a second member pivotally coupled to said first member and having a second periphery surface;

said first periphery surface and said second periphery surface having mating surfaces to form a friction fit for locking said first member and said second member in a closed condition to form a container;

said first member and said second member being nestable in other nestable containers when said first member and said second member are in an open condition; and wherein said nestable container comprises ornamentation for simulating a jack-o-lantern.

4. The nestable container of claim 3 wherein said first periphery surface and said second periphery surface each comprise a cut-out located at a top portion of said respective surfaces, said cut-outs forming an aperture when said first and second members are in said closed condition.

5. The nestable container of claim 4 wherein said first and second members comprise a plurality of ribs.

6. The nestable container of claim 5 wherein said ornamentation comprises recesses in said first member.

7. The nestable container of claim 6 further comprising decorative stickers to be applied within said recesses.

8. The nestable container of claim 7 wherein said decorative stickers are light-reflective.

9. The nestable container of claim 8 wherein said first member further comprises a perforation along a top portion of said first member permitting said container to have an opening when said first member and said second member are in said closed condition.

* * * * *